US009988796B2

(12) United States Patent
Bosio

(10) Patent No.: US 9,988,796 B2
(45) Date of Patent: Jun. 5, 2018

(54) PULL-OUT SPRAYHEAD WITH IMPROVED MAGNETIC COUPLING SYSTEM

(71) Applicant: AMFAG S.r.l., Casaloldo (MN) (IT)

(72) Inventor: Orlando Bosio, Casaloldo (IT)

(73) Assignee: AMFAG S.R.L., Casaloldo (MN) (IT)

( * ) Notice: Subject to any disclaimer, the term of this patent is extended or adjusted under 35 U.S.C. 154(b) by 101 days.

(21) Appl. No.: 15/061,126

(22) Filed: Mar. 4, 2016

(65) Prior Publication Data

US 2016/0258143 A1 Sep. 8, 2016

(30) Foreign Application Priority Data

Mar. 6, 2015 (IT) ..... MI2015A0343

(51) Int. Cl.
*E03C 1/00* (2006.01)
*E03C 1/04* (2006.01)

(52) U.S. Cl.
CPC ..... *E03C 1/0404* (2013.01); *E03C 1/0401* (2013.01); *E03C 2001/0415* (2013.01); *E03C 2001/0417* (2013.01)

(58) Field of Classification Search
CPC ..... E03C 1/0404; E03C 1/0401; E03C 2001/0415; E03C 2001/0417
USPC ..... 4/678; 137/801
See application file for complete search history.

(56) References Cited

U.S. PATENT DOCUMENTS 5,858,215 A * 1/1999 Burchard ..... B01D 35/04 137/551
8,127,782 B2 * 3/2012 Jonte ..... E03C 1/05 137/1
2001/0020302 A1 * 9/2001 Bosio ..... B05B 1/1618 4/677
2006/0283511 A1 * 12/2006 Nelson ..... E03C 1/0404 137/801
2008/0185060 A1 * 8/2008 Nelson ..... E03C 1/0404 137/801
2010/0170587 A1 * 7/2010 Kaess ..... E03C 1/0404 137/801
2011/0100478 A1 * 5/2011 Allen ..... F16K 31/602 137/15.01

(Continued)

FOREIGN PATENT DOCUMENTS

EP 2 824 246 1/2015

OTHER PUBLICATIONS

Italian Search Report dated Oct. 21, 2015 in corresponding Italian Patent Application No. MI20150343.

*Primary Examiner* — Benjamin R Shaw
(74) *Attorney, Agent, or Firm* — Wenderoth, Lind & Ponack, L.L.P.

(57) ABSTRACT

Pull out sprayhead (1) for a faucet, comprising: an inlet fitting (10), provided with a coupling end (10*d*) connectable to a extractable water supply pipe; a supply mouth (11*a*) in fluid connection with said attachment end (10*d*); and a magnet (12) fixed at the inlet fitting (10) and prearranged to allow a releasable connection of said pull-out sprayhead (1) to a faucet neck (20), said magnet (12) being arranged in a housing chamber (13), defined between an outer wall of said inlet fitting (10) and a covering nut (14), within which an insulating sleeve (30) is placed, distinct from the covering nut (14) and interposed between the inlet fitting (10) and the magnet (12), so as to minimize the heat flow occurring between a supplied fluid and the magnet (12) through the inlet fitting (10).

11 Claims, 4 Drawing Sheets

(56) References Cited

U.S. PATENT DOCUMENTS

| | | | | |
|---|---|---|---|---|
| 2012/0042973 | A1* | 2/2012 | Ko | E03C 1/0404 137/801 |
| 2014/0026980 | A1* | 1/2014 | Esche | E03C 1/0404 137/315.01 |
| 2014/0166124 | A1* | 6/2014 | Davidson | E03C 1/0404 137/315.01 |
| 2014/0251451 | A1* | 9/2014 | Yang | E03C 1/0404 137/315.01 |
| 2015/0013812 | A1 | 1/2015 | Bosio | |

* cited by examiner

PULL-OUT SPRAYHEAD WITH IMPROVED MAGNETIC COUPLING SYSTEM

FIELD OF APPLICATION

The present invention refers to a pull-out sprayhead for a faucet, in particular for a kitchen faucet.

Such devices find useful application in the field of fittings and accessories for plumbing fixtures.

KNOWN ART

Faucets equipped with a pull-out sprayhead are today commonly adopted, especially as mixers for the kitchen sink. They have a supply appendix, commonly called sprayhead, which can be extracted from its seat on the neck of the mixer to allow an efficient direction of the water jet. A flexible tube, generally placed inside the body of the mixer but partially removable to follow the movements of the sprayhead, keeps the latter connected to the water supply.

A technical relevant aspect of the above described devices concerns the connection of the sprayhead to the body of the faucet. Such connection in fact must enable easy and intuitive detaching and repositioning by the user, while ensuring a stable and precise coupling of the two components. In fact, if the first need derives from clear functional considerations, the second aspect influences the aesthetic perception of the product by the user.

A recently introduced type of connection, which fulfils in an optimal way both these requirements, provides a magnetic coupling between the sprayhead and the neck of the mixer, achieved by respectively combining a magnet and a ferromagnetic element one to the other, of the two elements to connect.

Pull-out sprayheads with a magnetic coupling system are disclosed for instance in prior art documents: US 2012/042973 A1; US 2008/185060 A1; and US 2014/251451 A1.

A drawback linked to this solution, however, derives from a high sensitivity to corrosion shown by most of the permanent magnets used by the industry. Due to the moist environment in which it is located, the magnet which defines the connection of the sprayhead is likely to corrode during time, with possible surface damage and fast degradation of the magnetic properties.

Currently, in order to prevent this corrosion phenomenon, solutions are adopted in order to ensure a protection of the magnet from the action of water circulating in the duct.

For example as proposed in EP Patent Application No. 13176394.8 (i.e.: EP 2 824 246 A1), on behalf of the same Applicant, a protection nut associated above the attachment connection of the sprayhead can define a relatively sheltered housing chamber for an annular magnet adapted on said fitting.

Such solution, allowing an efficient sealing of the magnet housing chamber, does not appear to have totally eliminated the drawback of time degradation of the magnetic properties, which in some conditions of use remains relevant.

The technical problem of the present invention is therefore to realize a fixing system of the simple and reliable magnet which is analogous to the one implemented in the cited known art, which further minimizes the drawback of degradation of the magnetic properties.

SUMMARY OF THE INVENTION

The aforementioned technical problem is solved by a pull-out sprayhead for a faucet, comprising: an inlet fitting, with one attachment end being connectable to a removable water supply pipe; a supply mouth in fluid connection with said attachment end; a ring-shaped magnet designed to allow a releasable connection of said pull-out sprayhead to a faucet neck, said magnet being arranged in a housing chamber defined between an outer wall of said inlet fitting and a covering nut fastened to said inlet fitting; and within said housing chamber an insulating sleeve, distinct from covering nut and at least partially interposed between the inlet fitting and the magnet, such as to minimize the heat flow that occurs between a supplied fluid and the magnet through the inlet fitting.

In fact the inlet fitting, generally made of metal material, is traversed in use by the water supplied by the sprayhead. When the sprayhead supplies hot water, the inlet fitting therefore represents a ideal thermal bridge to transmit heat to the magnet. Now, the Applicant has observed how the continuous thermal changes to which the magnet is subjected are at least partially responsible of the degradation of its properties during time. The adoption of said insulating sleeve then allows a relevant increase of the useful life of the magnet, solving the technical problem underlying the present invention.

It must be noted that the pull-out sprayhead can comprise a shoulder solidly attached to the inlet fitting, which delimits said housing chamber at an end thereof. Such a shoulder, which can be produced in one piece with the inlet fitting or as a separate element but bound thereto, is in any case typically made of a metal material similar to that of the inlet fitting.

Thus, the insulating sleeve can comprise in addition to a tubular portion interposed between the magnet and the outer wall, also a planar portion interposed between the magnet and the shoulder.

Preferably, said insulating sleeve is made of a single piece, said planar portion being flange made integral with said tubular portion. In other words, the insulating sleeve is defined by a single piece with the "L" section interposed between the inlet fitting and the magnet both at the outer wall and the shoulder of the inlet fitting.

Alternatively, it is possible to realize the insulating sleeve in two or more separate pieces, for example the tubular portion may take the form of a cylinder and the planar portion of a separate but juxtaposed washer.

The insulating sleeve defined above can be placed in abutment against the shoulder of the inlet fitting, while the magnet can be inserted around the insulating sleeve, in abutment on its planar portion. The insulating sleeve is not therefore constrained to the inlet fitting, as well as the magnet does not have any constraints with respect to the insulating sleeve.

The covering nut is preferably cup-shaped, comprising a front collar opposed to the shoulder and which delimits the housing chamber at its upper end.

The magnet is preferably in contact with the covering nut, when this is positioned above the inlet fitting. In particular, the contact occurs between the magnet and the front collar defined above.

The tubular portion of the insulating sleeve preferably extends up to the proximity of the front collar.

A first annular gasket may therefore be tightened between a free end of the tubular portion and the front collar, thus making a waterproof seal at the interface between the covering nut and the outer wall of the inlet fitting.

The planar portion of the insulating sleeve preferably also extends to the proximity of the covering nut.

The use of a covering nut fastened above the inlet fitting is a simple, inexpensive and visually neutral way to realize the attachment of the magnet to the pull-out sprayhead; furthermore it defines a closed chamber which protects the element from direct contact with the water, preventing the corrosion.

The covering nut can in fact be removed by releasing the constraint with the inlet fitting, so as to allow the extraction of the magnet and then of the insulating sleeve, so as to facilitate maintenance operations.

To constrain the covering nut to the inlet fitting, the connection can be realized through a threaded connection.

Sealing means can also be positioned within the housing chamber, so as to seal said chamber and to prevent any water infiltration at its inside even more reducing the risk of corrosion.

It must be noted that the insulating sleeve is made of a thermo-insulating material, for example a rigid plastic, different from that of the inlet fitting which as mentioned above is preferably made of a metal material with high thermal conductivity.

Moreover, the material of the insulating sleeve can also be different from that of the covering nut. It must be noted in fact that the covering nut is preferably made of a metal material similar to that of the inlet fitting, for aesthetical and functional reasons.

Of course, the magnet contained in the sprayhead is arranged to interface with a magnetic or ferromagnetic element associated with the neck of the faucet. It must be noted that at said interface the magnet is not covered by the insulating sleeve, which would decrease the intensity of the magnetic coupling.

Further characteristics and advantages will become more apparent from the detailed description given below of the preferred but not exclusive embodiment of the present invention, with reference to the accompanying figures given by way of non-limiting example.

DETAILED DESCRIPTION

Figure 1:
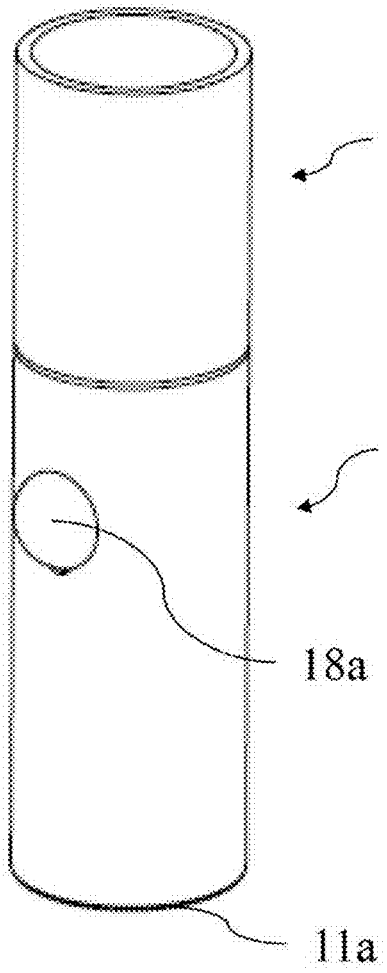
FIG. 1 is a perspective view of the pull-out sprayhead according to a first embodiment of the present invention, associated with a neck of a faucet.
Figure 2:
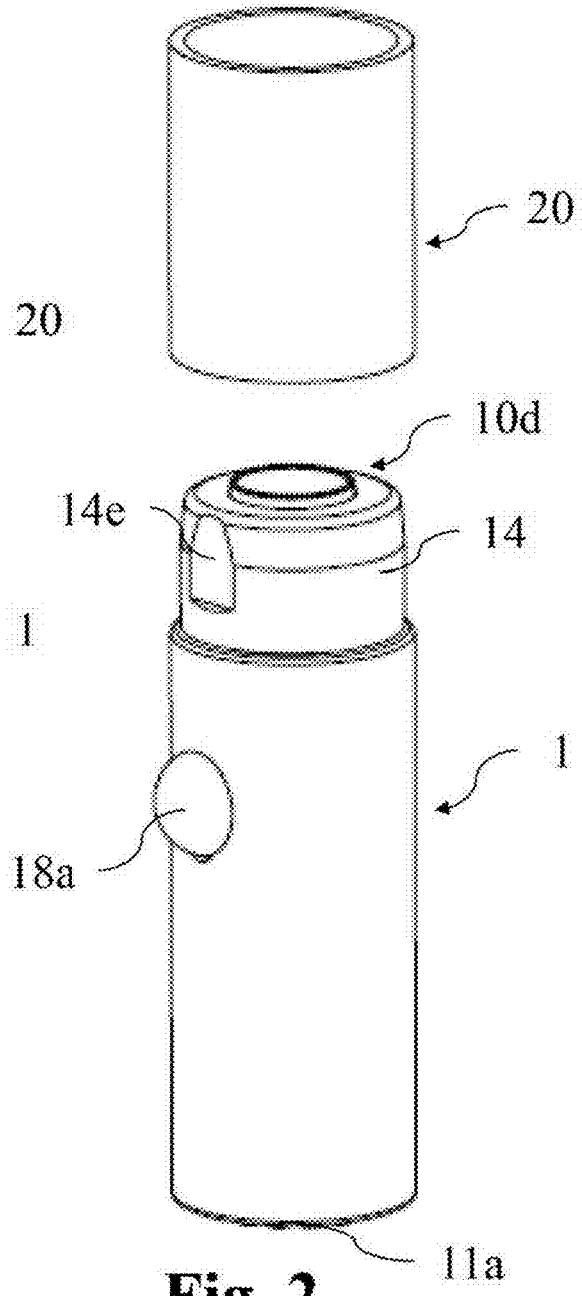
FIG. 2 is a perspective view of the pull-out sprayhead and of the neck of the faucet of FIG. 1 in a dissociated configuration.
Figure 3:
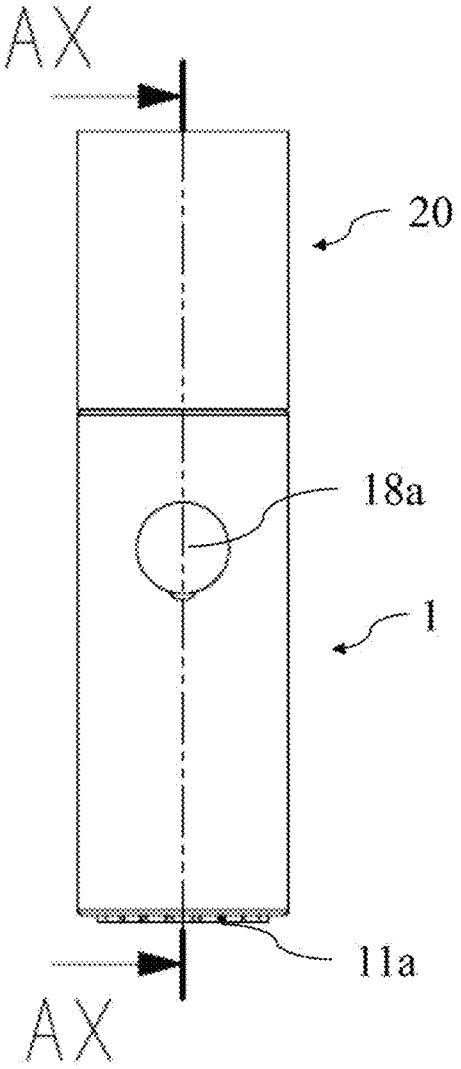
FIG. 3 is a side view of the pull-out sprayhead and of the neck of the faucet of FIG. 1.
Figure 4:
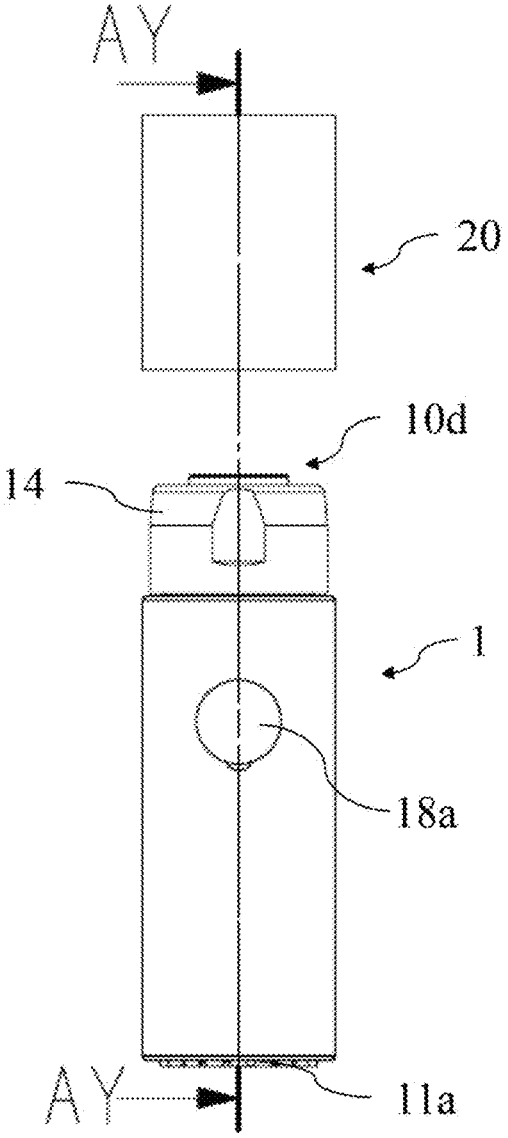
FIG. 4 is a side view of the pull-out sprayhead and of the neck of the faucet of FIG. 3 in a dissociated configuration.

With reference to the accompanying FIGS. 1-6, 1 generally designates a pull-out sprayhead, realized according to a first embodiment of the present invention, intended to couple in a releasable way to a faucet, preferably a kitchen mixer. In the Figures only the end portion of said faucet is shown, that is the neck 20 inside of which the pull-out sprayhead 1 is inserted, in its rest configuration.

It must be noted that the pull-out sprayhead 1 can be marketed independently with respect to the body of the faucet to which it is associated; is also possible, by means of minimal structural modifications made at the outlet mouth, to adapt existing faucets to allow the mounting of the pull-out sprayhead 1 on same.

The pull-out sprayhead 1 extends longitudinally from one attachment end 10*d* to a supply mouth 11*a*.

At the attachment end 10*d*, according to the procedures described below, a flexible water supply pipe is connected, which crosses the body of the faucet and is also connected to the water mains. The water from the water mains is thus introduced into a flow path 100 defined within the pull-out sprayhead, exiting into the supply mouth 11*a* opposed to the attachment end 10*d*. The flow path 100 crosses through a selector device 18, that is, a flow diverter configurable in two alternative positions, which allows to modify the conformation of the flow exiting from the supply mouth 11*a*.

The pull-out sprayhead 1 in its rest configuration is mounted in correspondence of the mouth of the neck 20 of the faucet, and defines a physical continuity with respect to said neck 20. In a configuration of use, the pull-out sprayhead 1 can be detached from said neck 20, dragging with itself the flexible tube which connects it to the water mains.

The rest configuration mentioned above is maintained due to the action of magnetic attraction developing between a magnet 12, integral with the pull-out sprayhead, and a ferromagnetic element 21, integral on the other hand to the neck 20 of the faucet. The conformations and the fixing mode of these elements will result from the following description.

The pull-out sprayhead 1 comprises a tubular body 19 which houses the aforesaid selector device 18 and presents the supply mouth 11*a* its lower end.

In the preferred embodiment presently described, said tubular body 19 has a cylindrical shape and a diameter equal to that of the analogous cylindrical configuration of the neck 20 of the faucet, to which the pull-out sprayhead 1 is associated.

The tubular body 19 houses at the upper end opposed to the supply mouth 11*a* an inlet fitting 10 partially protruding from said tubular body 19 and realizes the hydraulic connection with said flexible supply pipe. The inlet fitting 10 has a tubular shape, and defines in its inside the upstream portion of the flow path 100 internal to the pull-out sprayhead 1. Within this portion a connection thread 10*h* is realized, destined to the attachment end of the removable water supply pipe.

The inlet fitting 10 is divided into a distal portion 10*a* and a proximal portion 10*b*, which are mainly distinguished by their external morphology. The distal portion 10*a* separated from the tubular body 19, has in fact a cylindrical structure with a diameter smaller than the underlying proximal portion 10*b*.

The proximal portion 10*b* of the inlet fitting 10 has a socket 10*i* which is introduced inside a hole of equal cross-section made on the upper surface of the tubular body 19. The socket 10*i* is provided with a circular flange holding it inside the tubular body 19; between the flange and the upper surface of the tubular body 19 a fitting ring 10*j* is also interposed. It must be noted that the socket 10*i* has two facets, so as the inlet fitting 10 is rotatably locked with respect to the tubular body.

Above the socket 10*i*, the proximal portion 10*b* has an external thread 10*f* permitting the screwing to the inlet fitting 10 of a covering nut 14 described below. The socket 10*i* is separated from the external thread 10*f* by a circumferential groove 10*g*.

The external thread 10*f* of the proximal portion 10*b* of the inlet fitting is formed on a ring-shaped enlargement made in one piece, which defines the upper shoulder 10*c* and the lower groove 10*g*.

In a second alternative embodiment, similar to that described in FIGS. 8-10 of EP Patent application No. 13176394.8, such enlargement is obtained by means of a double-threaded bush which is screwed, by means of its internal thread, on a corresponding peripheral thread of the inlet fitting. The external thread of the bushing instead permits the screwing of the covering nut onto the inlet fitting.

The inlet fitting 10 then has in the first and second embodiment a different morphology of the distal portion 10*a*. In fact, while in the first embodiment, illustrated in FIGS. 5 and 6, a variation is present in the outer diameter of the distal portion 10*a* at said enlargement, in the second embodiment of the distal portion it has a constant outer diameter.

In both cases, the reduction in diameter between distal portion 10*a* and proximal portion 10*b* defines a shoulder 10*c*, which forms between the distal portion 10*a* of the inlet fitting 10 and the covering nut 14, an annular housing chamber 13.

The covering nut 14 is cup-shaped with a lateral liner 14*a* and a front collar 14*b* closing the annular end of the housing chamber 13 opposed to the shoulder 10*c*. The lateral liner 14*a* has an internal thread 14*c* which engages on the external thread 10*f* of the inlet fitting 10.

The housing chamber 13 is arranged to enclose and seal, due to the presence of sealing means, the magnet 12 and an insulating sleeve 30, made of a thermal insulating material such as for example a rigid plastic.

The insulating sleeve 30 also has an annular shape with an internal diameter constant and sufficient to allow the insertion on the distal portion 10*a* of the inlet fitting 10. The insulating sleeve 30 is then provided in order to at least partially enclose the outer wall 10*e* of the inlet fitting 10.

In a preferred embodiment, said insulating sleeve 30 has a "L" section including a tubular portion 31 and a planar portion 32, the latter having an outer diameter greater than the adjacent tubular portion 31.

In particular, the planar portion 32 is provided in order to face the outlet mouth 11*a* of the pull-out sprayhead 1, so as to be in abutment against the shoulder 10*c* of the inlet fitting 10.

In this way, within the housing chamber 13 between the insulating sleeve 30 and the covering nut 14, an annular volume is obtained, which is smaller than the volume of the housing chamber 13, provided for containing the magnet 12, and which is separate from the inlet fitting 10.

The magnet 12 is inserted around the insulating sleeve 30, resting on the planar portion 32 of the "L" section of the same.

Substantially, the tubular portion 31 of the insulating sleeve 30 is interposed between the outer wall 10 of the inlet fitting 10 and the magnet 12, whereas the planar portion 32 is interposed between the shoulder 10*c* and the above cited magnet 12.

It must be noted that such configuration permits to avoid a direct contact between the inlet fitting, inside which the supplied water flows, and the magnet, by thermally insulating the same with respect to the heat transmitted through the inlet fitting during the passage of hot water.

Furthermore it must be noted that, in an embodiment according to the present invention, the "L" section of the insulating sleeve can be achieved by inserting a plurality of elements, with annular shape and different outer diameters, in a position adjacent to the inlet fitting, so that each element realizes an annular portion of said "L" section.

Furthermore a person skilled in the art, in order to thermally insulate the magnet, could insert on the inlet fitting an insulating sleeve having a cross-sectional shape different from the shape described, consisting of a single element or multiple elements, however comprised within the scope of protection of the present invention.

Figure 5:
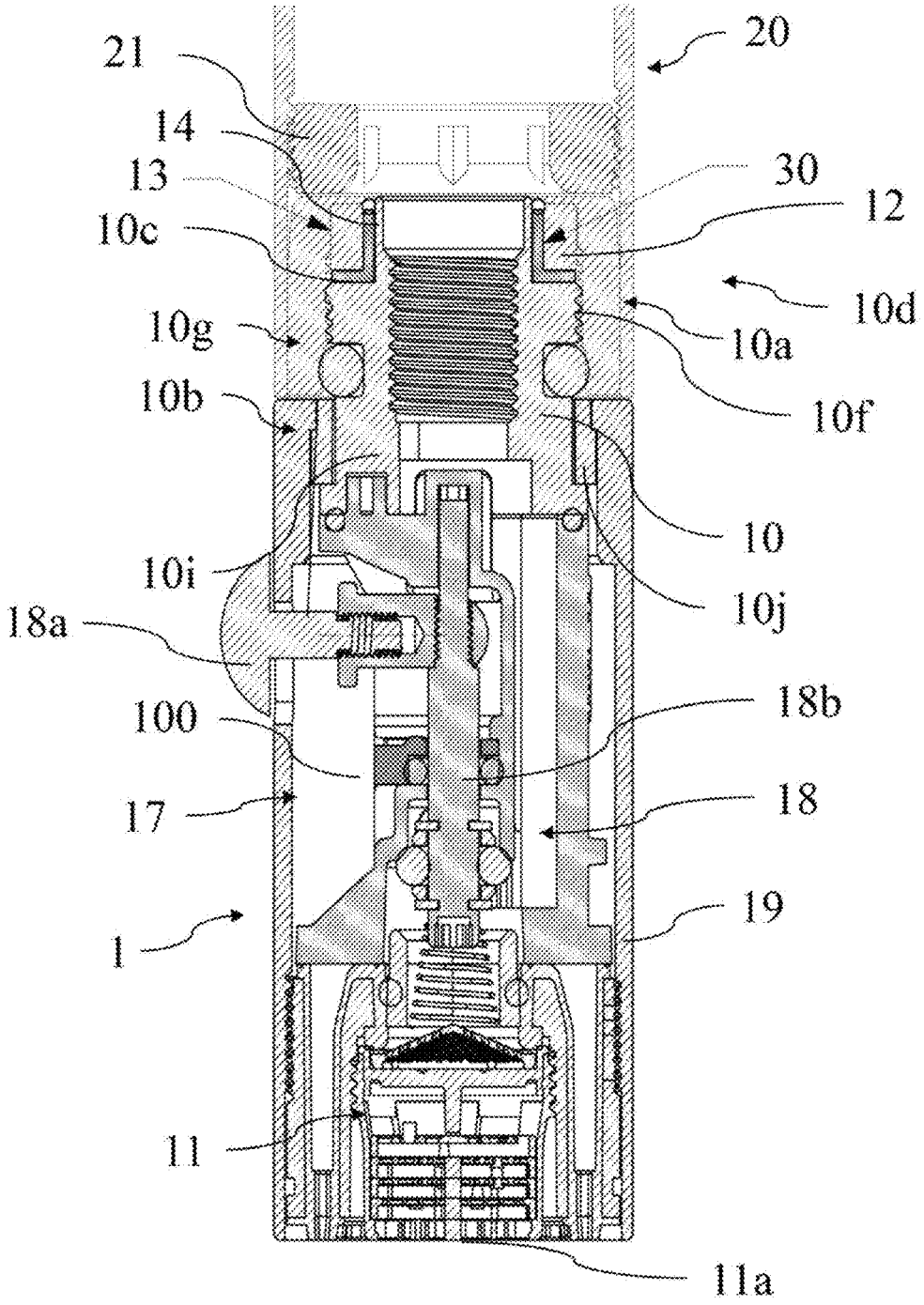
FIG. 5 is a view of the pull-out sprayhead and of the neck of the faucet sectioned along the plane AX-AX of FIG. 3.
Figure 6:
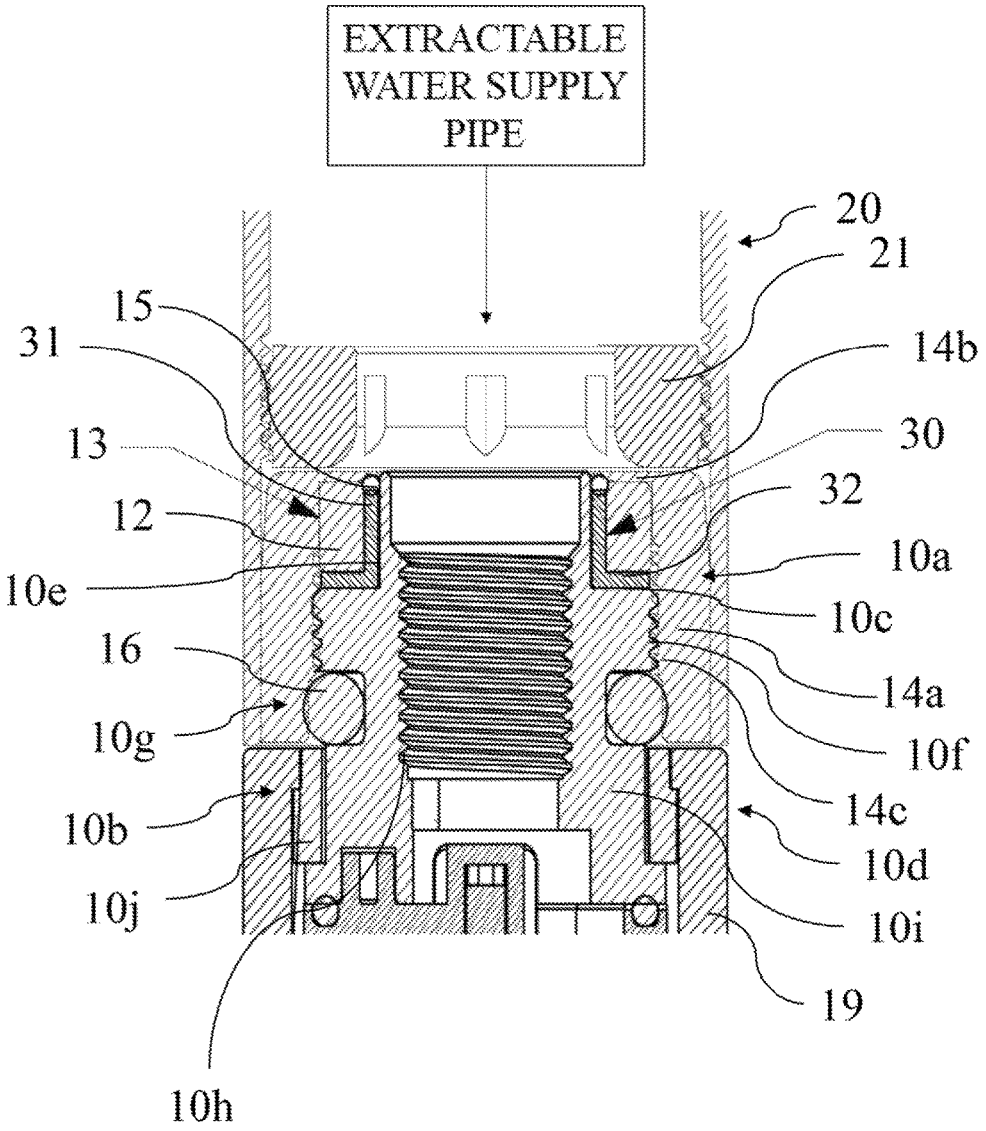
FIG. 6 is an enlarged sectioned detailed view of FIG. 5.

Furthermore, as can be seen from FIGS. 5-6, the magnet 12 is arranged to be located superiorly in contact with the front collar 14*b* of the covering nut 14, with advantages on the stability of coupling realized between the sprayhead and the faucet, as will appear more clearly from the following.

The magnet 12 and the insulating sleeve 30 are then maintained in position due to the presence of the covering 14; while the latter can be bound to other elements of the pull-out sprayhead 1 and in particular to the inlet fitting 10, no retaining means are provided for the magnet and the insulating sleeve, which are inserted around the distal portion 10*a* of the inlet fitting and positioned resting on the shoulder 10*c* of the above inlet fitting 10.

The sealing means previously mentioned, are capable to protect the magnet from the surrounding moisture, and comprise a first annular gasket 15 and a second annular gasket 16.

The first annular gasket 15 is interposed between the free end of the tubular portion 31 of the insulating sleeve 30 and the front collar 14*b* of the covering nut 14, and encloses the distal portion 10 with the inlet fitting 10. By tightening the covering nut 14 on the inlet fitting 10, the compression of said gasket 15 is suitably realized on the insulating sleeve 30.

The second annular gasket 16, which defines a lower seal for the housing chamber 13, sits in the circumferential groove of the proximal portion 10*b* of the inlet fitting 10. Such gasket 16 is then arranged, with respect to the housing chamber 13, on the opposite side of the threaded connection between the covering nut 14 and the inlet fitting 10.

An end edge 14*d*, suitably flared of the covering nut 14, which extends up to the upper end of the tubular body 19, hides the second annular gasket 16 to the user's view.

Below the socket 10*i* of the inlet fitting 10, the tubular body 19 houses an intermediate stage 17 which internally defines the selector device 18, according to a shape known per se comprising functional elements 18*a*, 18*b*.

Below the above intermediate stage 17, the tubular body 19 also houses an output stage 11, comprising in particular one or more types of aerators/jet nozzles.

As can be seen from the above, the covering nut 14 defines an upper cap of the pull-out sprayhead 1 which, developing in protrusion with respect to the tubular body 19, surrounds the inlet fitting 10 and sealingly encloses the magnet 12 and the insulating sleeve 30.

In the rest configuration of the pull-out sprayhead 1, such covering nut 14 is completely introduced into the mouth of the neck 20 of the faucet, being interposed between the ferromagnetic element 21 and the magnet 12, whereas the upper end of the tubular body 19 stops in abutment beneath said mouth.

One skilled in the art will appreciate how the stability of the coupling to be carried out is not impaired by the presence of insulating and sealing means in the vicinity of the magnet, as between this and the ferromagnetic element only the front collar of the covering nut of negligible thickness is interposed.

The insulating sleeve can instead have a greater thickness. Therefore, the interposition of the same between the ferromagnetic element and the magnet is avoided, as it would cause a weakening of the force of magnetic attraction with respect to a small advantage in terms of thermal insulation.

The ferromagnetic element 21, which in the present case has the shape of an externally threaded ring, is screwed on a corresponding internal thread made in the neck 20 of the faucet, in a spaced relation with respect to the mouth. At the rest configuration previously described, said ferromagnetic ring 21 is flush with the outer surface of the front collar 14*c* of the covering nut 14.

It must be noted that the ferromagnetic element 21 cited above can be easily fixed with alternative systems to that described above, for example by gluing, at the inside of the neck of already existing faucets, in order to adapt them to the pull-out sprayhead 1 according to the present invention.

An advantage of the present invention concerns the possibility of preserving the properties of the magnet from the harmful action of external agents, such as heat and moisture, due to the presence of a suitable housing chamber, separated from the surrounding environment.

Another advantage of the present invention derives from the simplicity and relative inexpensiveness of the attachment system of the magnet to the pull-out sprayhead.

It is also of great advantage the possibility to easily replace the elements present in the housing chamber, and in particular the magnet that makes the connection of the sprayhead, being it sufficient to unscrew the protective nut in order to access to the element.

Still another advantage resides in the impermeability of the housing chamber of the magnet, thereby permitting to preserve the magnet from corrosion.

A further advantage derives from the fact that the pull-out sprayhead according to the present invention can be easily adapted to faucets which originally did not provide for the magnetic coupling.

Obviously, to the invention described above one skilled in the art, in order to satisfy contingent and specific requirements, may make numerous modifications and variants, all however contained within the scope of the invention as defined by the following claims.

The invention claimed is:

1. A pull-out sprayhead for a faucet, said pull-out sprayhead comprising:

an inlet fitting provided with a coupling end connectable to an extractable water supply pipe;

a supply mouth in fluid communication with said coupling end;

a ring-shaped magnet designed to allow releasable connection of said pull-out sprayhead to a faucet neck, said magnet being arranged in a housing chamber defined between an outer wall of said inlet fitting and a covering nut fastened to said inlet fitting;

an insulating sleeve, located within said housing chamber, distinct from said covering nut and at least partially interposed between said inlet fitting and said magnet, so as to reduce heat flux occurring between a supplied fluid and said magnet through said inlet fitting, wherein said insulating sleeve is made of a thermally insulating material, said thermally insulating material be different from a material of said inlet fitting.

2. The pull-out sprayhead according to claim 1, further comprising a shoulder, solidly attached to said inlet fitting, which delimits said housing chamber at an end thereof, wherein said insulating sleeve comprises a tubular portion interposed between said magnet and said outer wall and a planar portion interposed between said magnet and said shoulder.

3. The pull-out sprayhead according to claim 2, wherein said insulating sleeve is made of a single piece, said planar portion being a flange integral with said tubular portion.

4. The pull-out sprayhead according to claim 2, wherein said covering nut is cup-shaped, and comprises an end collar opposite to said shoulder and which delimits said housing chamber at its upper end.

5. The pull-out sprayhead according to claim 4, wherein said tubular portion extends to a proximity of said end collar.

6. The pull-out sprayhead according to claim 5, further comprising at least a first annular gasket tightened between a free end of said tubular portion and said end collar.

7. The pull-out sprayhead according to claim 5, wherein said planar portion extends to a proximity of said covering nut.

8. The pull-out sprayhead according to claim 1, wherein said covering nut is fastened to said inlet fitting by a threaded connection.

9. The pull-out sprayhead according to claim 1, wherein said housing chamber is sealed with sealing means impermeable to water.

10. The pull-out sprayhead according to claim 1, wherein said thermally insulating material is different from a material of said covering nut.

11. The pull-out sprayhead according to claim 1, wherein said thermally insulating material of said insulating sleeve has a lower thermal conductivity than said material of said inlet fitting.

* * * * *